US010906613B1

(12) United States Patent
Byal

(10) Patent No.: US 10,906,613 B1
(45) Date of Patent: Feb. 2, 2021

(54) BOAT TOP

(71) Applicant: Christopher F. Byal, Lakewood Ranch, FL (US)

(72) Inventor: Christopher F. Byal, Lakewood Ranch, FL (US)

( * ) Notice: Subject to any disclaimer, the term of this patent is extended or adjusted under 35 U.S.C. 154(b) by 0 days.

(21) Appl. No.: 16/580,560

(22) Filed: Sep. 24, 2019

(51) Int. Cl.
*B63B 17/00* (2006.01)
*B63B 17/02* (2006.01)

(52) U.S. Cl.
CPC ..... *B63B 17/02* (2013.01)

(58) Field of Classification Search
CPC ..... B63B 17/02; B63B 2017/026
USPC ..... 114/343, 352, 361, 364
See application file for complete search history.

(56) References Cited

U.S. PATENT DOCUMENTS 4,558,713 A 12/1985 Hagler et al.
5,215,109 A * 6/1993 Kent, Jr. ..... B63B 17/02 135/118
5,520,139 A * 5/1996 King ..... B63B 17/02 114/361
5,706,752 A * 1/1998 Menne, Jr. ..... B63B 17/02 114/361
5,752,537 A 5/1998 Kranzler
5,803,104 A * 9/1998 Pollen ..... B63B 17/02 114/361
6,439,150 B1 8/2002 Murphy et al.
6,637,364 B1 * 10/2003 Campeau ..... B63B 17/02 114/361
7,424,862 B1 * 9/2008 Wagner ..... B63B 17/02 114/361
8,025,194 B2 9/2011 Jesewitz
8,495,967 B2 7/2013 Williams et al.
8,905,281 B2 12/2014 Jesewitz
9,038,875 B2 5/2015 Jesewitz
9,150,283 B2 * 10/2015 Braaten-Boyd ..... B63B 17/02
10,286,982 B2 5/2019 Sheedy et al.

* cited by examiner

*Primary Examiner* — Daniel V Venne
(74) *Attorney, Agent, or Firm* — Bryan L. Loeffler, Esq.; Loeffler IP Group, PA

(57) ABSTRACT

A boat top (1) having a collapsible frame that may be disassembled and stored when not in use and that provides storage for items, such as paddleboards, floating docks and so forth that double as a roof to provide shade and protection from the elements.

12 Claims, 5 Drawing Sheets

BOAT TOP

FIELD OF THE INVENTION

This invention relates to tops for boats that provide shade and protection from the elements and, more particularly, a boat top having a collapsible frame that can be disassembled and stored when not in use and that provides storage for items, such as paddleboards, floating docks and so forth, when assembled and in use.

BACKGROUND OF THE INVENTION

Boat tops provide shelter and protection for passengers on boats as well as for the electronics and other equipment located on the boat. Various styles and configurations of boat tops are commonly known in the prior art. Conventional boat tops include T-tops and Bimini tops, each of which has a rigid framework attached to the center console and/or decks of a boat. Many conventional boat top assemblies are permanently or semi-permanently secured to the boat.

As result of this fixed positioning, many boats cannot be stored in standard sized garages or in commercial toped marine storage facilities because of the height of the boat top exceeds the standard height of those facilities.

Therefore, a need exists for a boat top having a collapsible frame that may be easily disassembled and stored when not in use and that provides storage for items, such as paddleboards, floating docks and so forth, when assembled and in use.

SUMMARY OF THE INVENTION

The primary object of the present invention is to provide a boat top having a collapsible frame that may be disassembled and stored when not in use and that provides storage for items, such as paddleboards, floating docks and so forth, when assembled and in use.

An additional object of the present invention is to provide a boat top that doubles as a utility rack for storing paddle boards, floating docks, kayaks and other accessories that, when stored, provide a roof or shade canopy for the boat top.

An additional object of the present invention is to provide a boat top that may be used on other surfaces, such as docks, trailers, trucks and so forth.

The present invention fulfills the above and other objects by providing a collapsible frame supported by two pylons mounted to a boat deck. The pylons may be mounted on a boat deck on opposing sides of a center console, thereby positioning the boat top over the operator and the controls of the boat, or in the case of a sport boat with a helm to one side, the pylons may be mounted to the deck and/or gunwale. Each pylon has at least two apertures located on an upper portion thereof that provide openings to angled bores each extending from its respective aperture and downward to an opposing side of the respective pylon. The two apertures on each pylon are preferably located at the same height on the pylon and on opposing sides of the pylon. In addition, the two apertures are preferably offset from each other to prevent the respective bores from intersecting each other.

Diagonal support arms are inserted into the apertures and angled bores of each pylon to create a Y-shape wherein top ends of the diagonal support arms hold cross members in an elevated position above the center console. The cross members form an elevated framework for carrying accessories, such as floating docks, paddle boards, wake boards and so forth. The accessories form a roof over the operator and the center console to provide shade and protection from the elements.

When not in use, the cross members and diagonal support arms may be removed from the pylons, broken down and stored, thereby only leaving the pylons on the boat.

The above and other objects, features and advantages of the present invention should become even more readily apparent to those skilled in the art upon a reading of the following detailed description in conjunction with the drawings wherein there is shown and described illustrative embodiments of the invention.

BRIEF DESCRIPTION OF THE DRAWINGS

In the following detailed description, reference will be made to the attached drawings in which.

DESCRIPTION OF THE PREFERRED EMBODIMENTS

Figure 1:
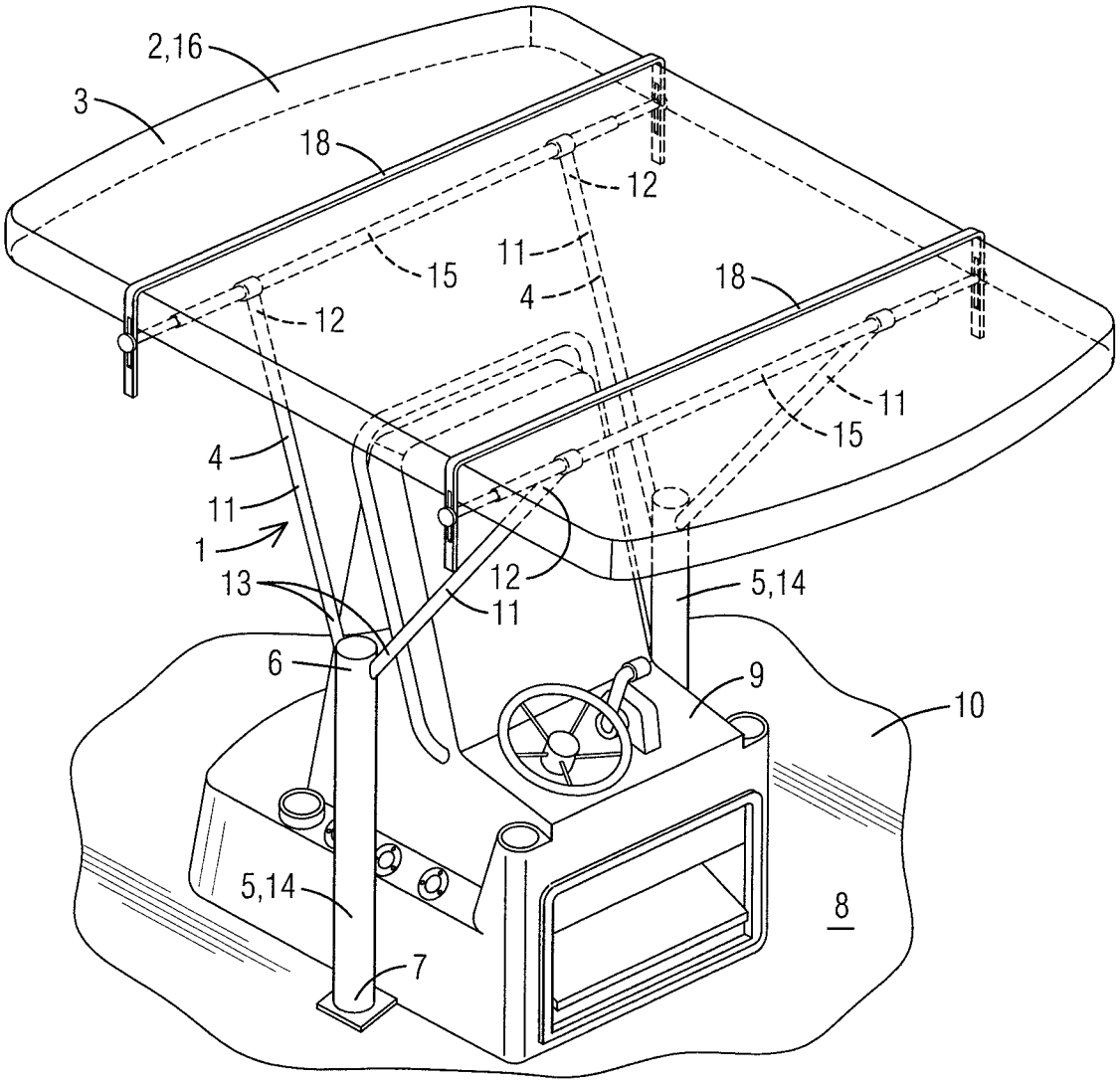
FIG. 1 is a perspective left side view of the boat top of the present invention in use and supporting a floating dock in a stored position.

For purposes of describing the preferred embodiment, the terminology used in reference to the numbered accessories in the drawings is as follows:

1. boat top, generally
2. accessory
3. roof
4. framework
5. pylon
6. top end of pylon
7. bottom end of pylon
8. boat deck
9. center console
10. boat
11. diagonal support arm
12. top end of diagonal support arm
13. bottom end of diagonal support arm
14. Y-shaped vertical support
15. cross member
16. floating dock
17. paddle board
18. strap
19. aperture
20. bore With reference to FIGS. 1 and 2, a perspective left side view and perspective left side view, respectively, of a boat top 1 of the present invention in use and supporting stored accessories 2 that double as a roof 3 or shade canopy are illustrated. The boat top 1 of the present invention comprises a collapsible framework 4 supported by two pylons 5 each having a top end 6 and a bottom end 7, wherein the bottom ends 7 of each pylon 5 are mounted to a boat deck 8 or other surface. The pylons 5 may be mounted on opposing sides of a center console 9 of a boat 10, thereby positioning the boat top 1 over controls of the boat 10.

Figure 2:
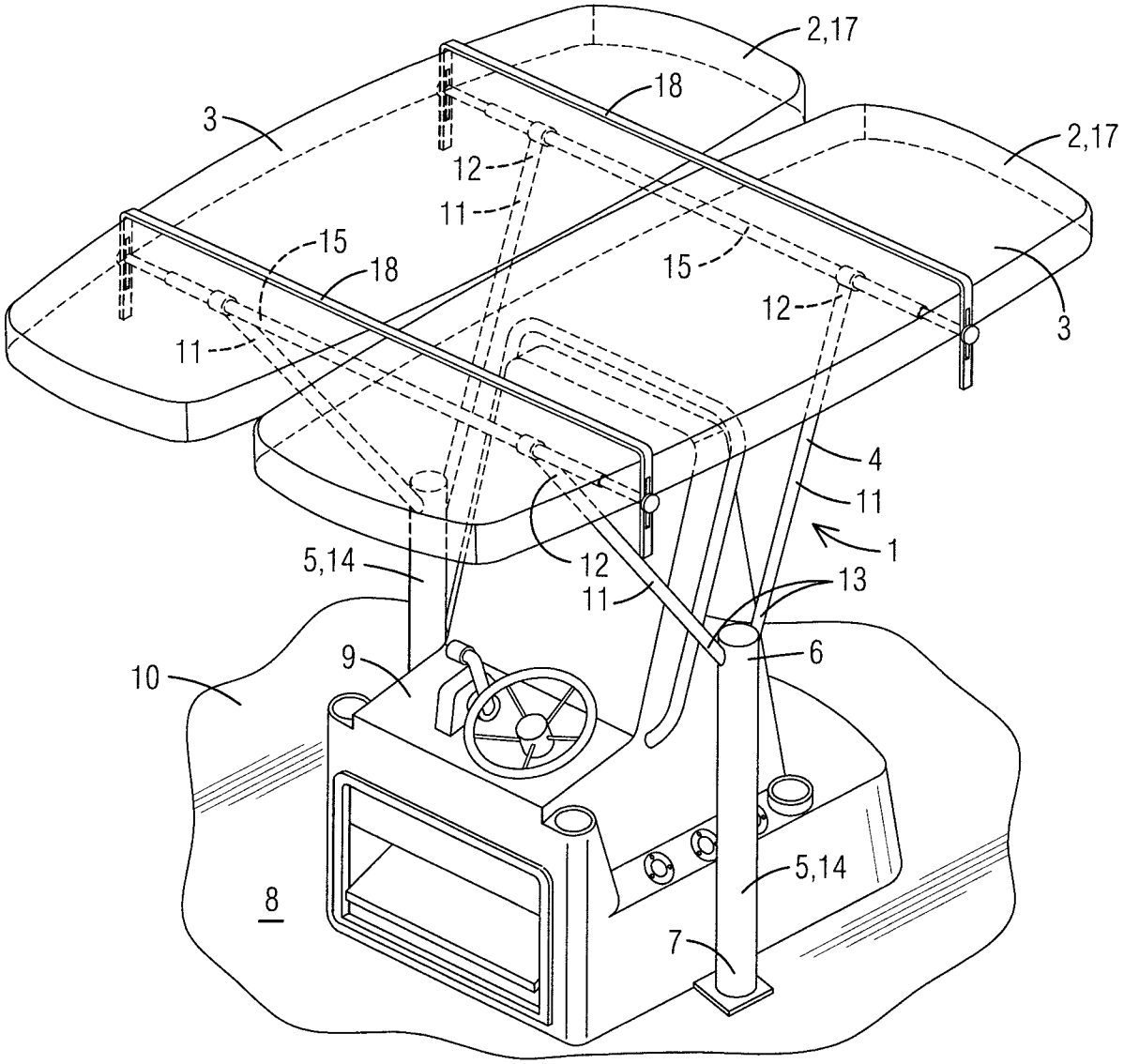
FIG. 2 is a perspective right side view of the boat top of the present invention in use and supporting paddle boards in a stored position.

Diagonal support arms 11, each having top ends 12 and bottom ends 13, extend upward and outward in opposing directions from an upper portion of each pylon 5 to create Y-shaped vertical supports 14 on each side of the center console 9. Top ends 12 of the diagonal support arms 11 hold horizontal cross members 15 in an elevated position above the center console 9. The horizontal cross members 15 form an elevated framework for carrying accessories 2, such as a floating dock 16 (as illustrated in FIG. 1), paddle boards 17 (as illustrated in FIG. 2), wake boards, kayaks and so forth. The accessories 2 are secured to the horizontal cross members 15 by one or more straps 18. The accessories 2 form a roof 3 over the center console 9 to provide shade and protection from the elements. The Diagonal support arms 11 and/or horizontal cross members 15 may be telescoping to adjust the size thereof.

Figure 3:
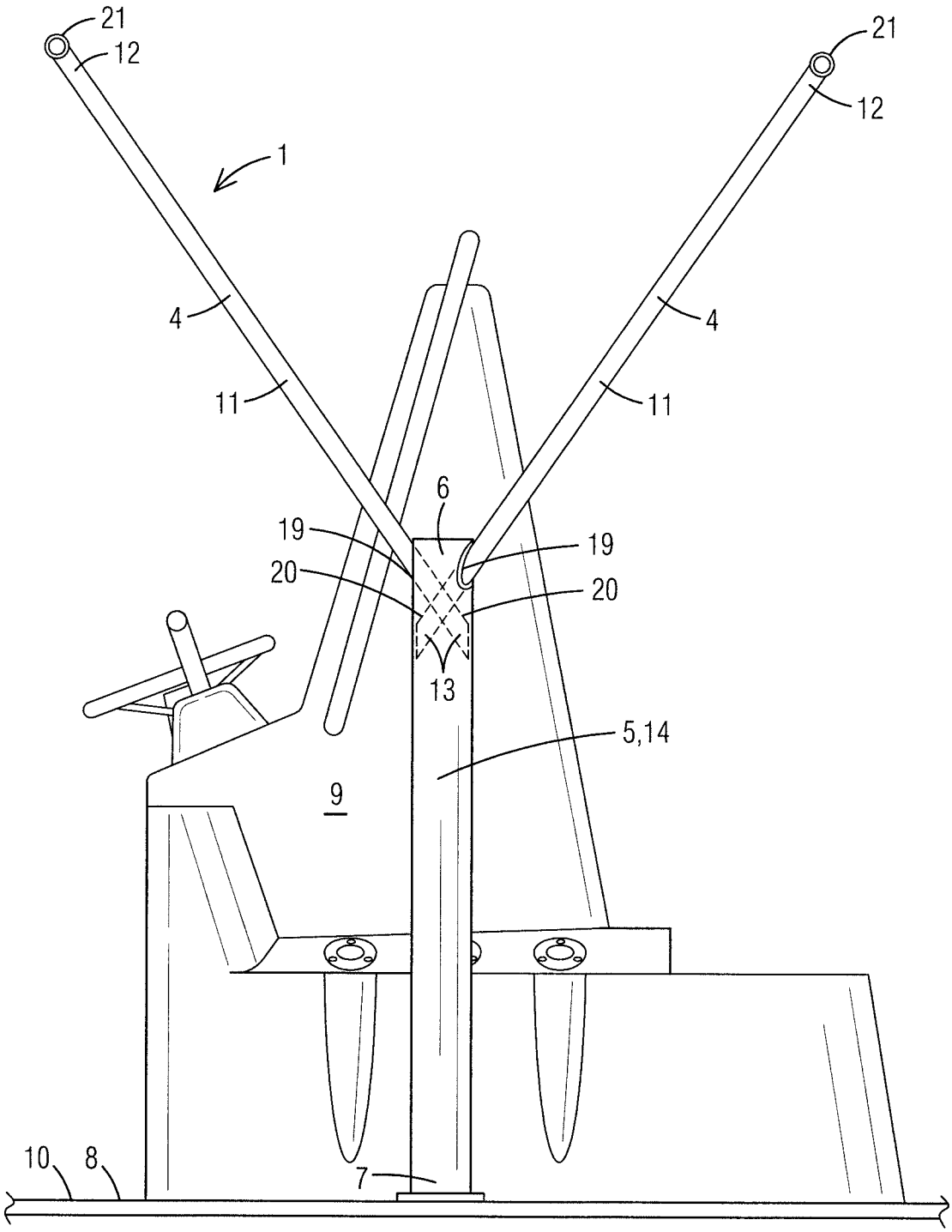
FIG. 3 is a side plan view of a framework of the boat top of the present invention.
Figure 4:
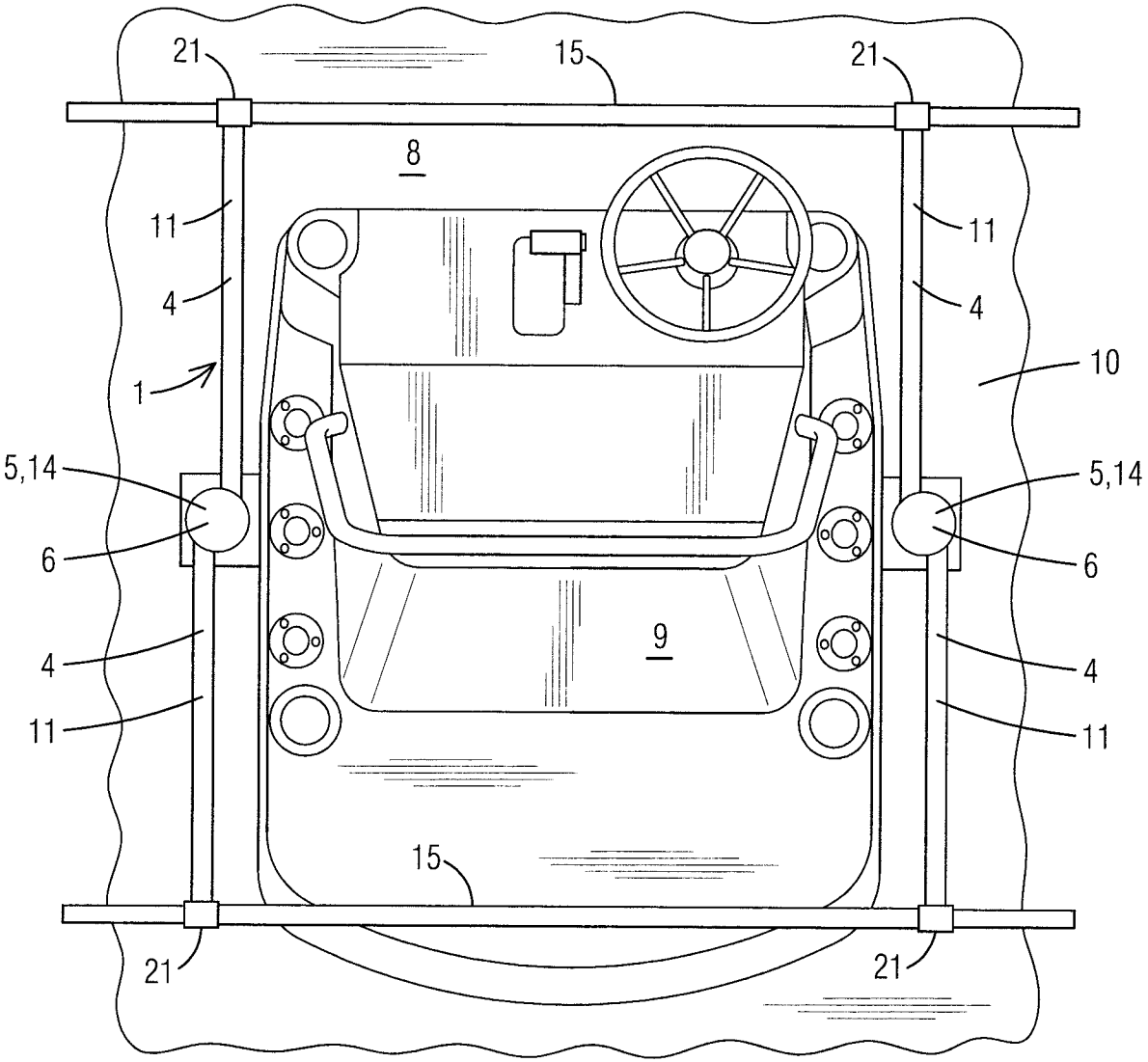
FIG. 4 is a top plan view the framework of the boat top of the present invention.
Figure 5:
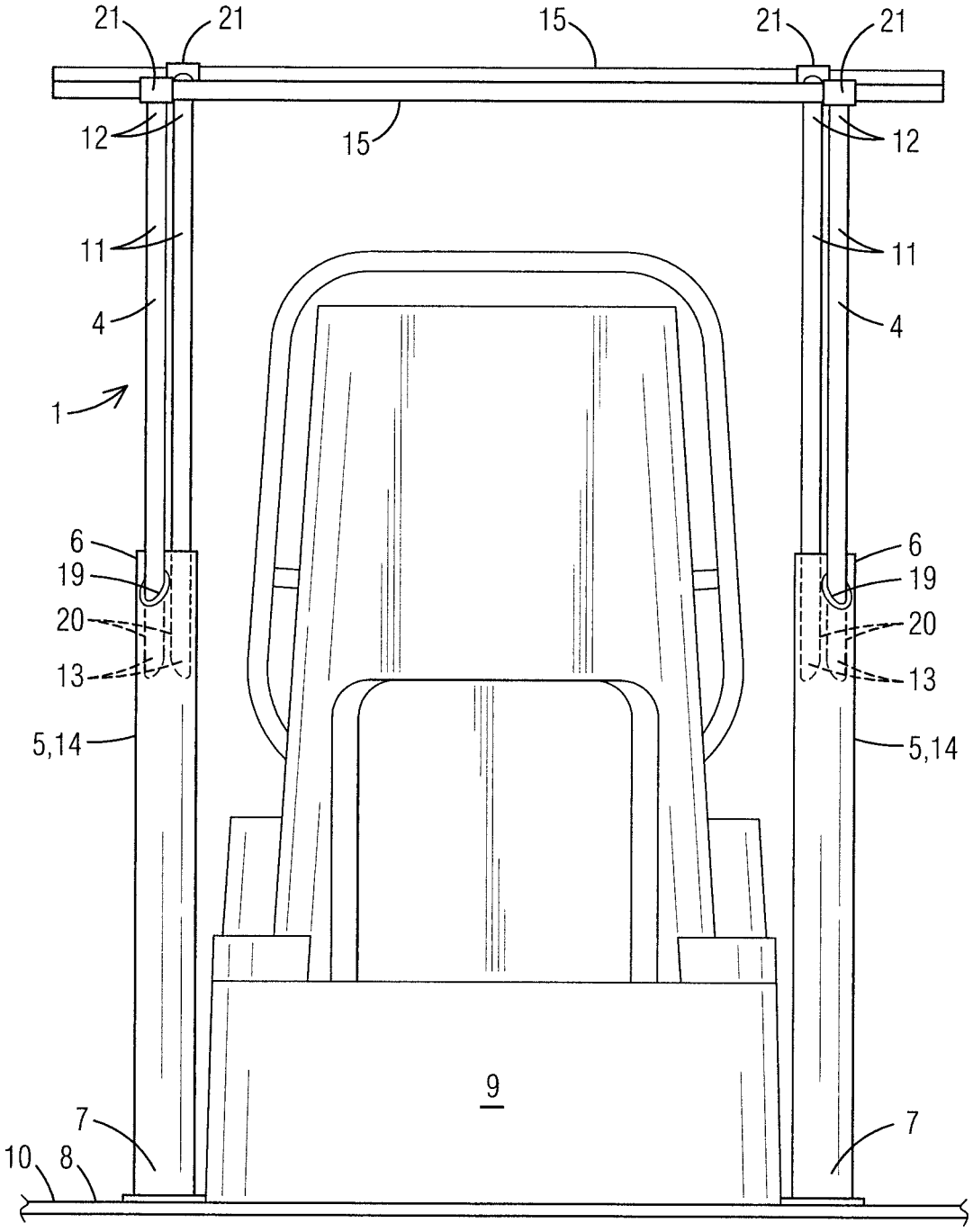
FIG. 5 is a front plan view the framework of the boat top of the present invention.

With reference to FIGS. 3-5, a side plan view, top plan view and front plan view, respectively, of a framework 4 of the boat top 1 of the present invention are illustrated. The boat top 1 of the present invention comprises a collapsible framework 4 supported by two pylons 5 each having a top end 6 and a bottom end 7, wherein the bottom ends 7 of each pylon 5 are mounted to a boat deck 8 or other surface. The pylons 5 may be mounted on opposing sides of a center console 9 of a boat 10, thereby positioning the boat top 1 over controls of the boat 10 (as illustrated in FIG. 4).

Each pylon 5 has at least two apertures 19 located on an upper portion thereof to provide openings to angled bores 20 each extending from its respective aperture 19 downward to an opposing side of the respective pylon 5. The two apertures 19 on each pylon 5 are preferably located at the same height on the pylon 19 and on opposing sides of the pylon 5. In addition, two apertures 19 on each pylon 5 are preferably offset from each other to prevent the respective angled bores 20 from intersecting each other.

Diagonal support arms 11, each having top ends 12 and bottom ends 13, extend upward and outward from an upper portion of each pylon 5 to create Y-shaped vertical supports 14 on each side of the center console 8. The bottom ends 13 of the diagonal support arms 11 are inserted into the respective apertures 19 and angled bores 20 of each pylon 5 to create a Y-shaped vertical supports 14 wherein the top ends 12 of the diagonal support arms 11 hold horizontal cross members 15 in an elevated position above the center console 9. The horizontal cross members 15 are preferably removeably attached to the diagonal support arms 11 via attachment means 21, such as tubular-shaped brackets, clamps, clips, and so forth, thereby allowing, the horizontal cross members 15 and diagonal support arms 11 may be removed from the pylons 5, broken down and stored, thereby only leaving the pylons 5 on the boat 10.

It is to be understood that while a preferred embodiment of the invention is illustrated, it is not to be limited to the specific form or arrangement of parts herein described and shown. It will be apparent to those skilled in the art that various changes may be made without departing from the scope of the invention and the invention is not to be considered limited to what is shown and described in the specification and drawings.

Having thus described my invention, I claim:

1. A boat top comprising:

two pylons each having a top end and a bottom end wherein the bottom ends of said two pylons are mountable to a horizontal surface;

said two pylons each having two diagonal support arms extending upward and outward from each of said two pylons in opposing directions to create two Y-shaped vertical supports;

and at least one cross member extending between said two Y-shaped vertical supports for supporting a roof in an elevated position.

2. The boat top of claim 1 wherein:

said two pylons each having apertures located on opposing sides thereof.

3. The boat top of claim 1 further comprising:

at least one strap located on said at least one cross member for securing a roof to said at least one cross member.

4. The boat top of claim 1 wherein:

said roof being formed from a boating accessory secured to said at least one cross member.

5. The boat top of claim 1 wherein:

said at least one cross member is telescoping.

6. The boat top of claim 1 wherein:

said diagonal support arms are telescoping.

7. A boat comprising:

a center console extending upward from a boat deck;

two pylons each having a top end and a bottom end wherein the bottom ends of said two pylons are mounted to said boat deck on opposing sides of said center console;

said two pylons each having two diagonal support arms extending upward and outward from each of said two pylons in opposing directions to create two Y-shaped vertical supports;

and at least one cross member extending between said two Y-shaped vertical supports for supporting a roof in an elevated position.

8. The boat of claim 7 wherein:

said two pylons each having apertures located on opposing sides thereof.

9. The boat of claim 7 further comprising:

at least one strap located on said at least one cross member for securing a roof to said at least one cross member.

10. The boat of claim 7 wherein:

said roof being formed from a boating accessory secured to said at least one cross member.

11. The boat of claim 7 wherein:

said at least one cross member is telescoping.

12. The boat of claim 7 wherein:

said diagonal support arms are telescoping.

* * * * *